US007128668B2

(12) United States Patent
Purcell

(10) Patent No.: US 7,128,668 B2
(45) Date of Patent: Oct. 31, 2006

(54) MAT—ADAPTED FOR USE AS A BASEBALL OR SOFTBALL ON-DECK CIRCLE

(76) Inventor: Mark Stanley Purcell, 16193 Sandy Creek Village Rd., Watertown, NY (US) 13601

( * ) Notice: Subject to any disclaimer, the term of this patent is extended or adjusted under 35 U.S.C. 154(b) by 49 days.

(21) Appl. No.: 10/854,380

(22) Filed: May 25, 2004

(65) Prior Publication Data

US 2005/0266939 A1 Dec. 1, 2005

(51) Int. Cl.
*A63C 19/12* (2006.01)

(52) U.S. Cl. ..... 473/504

(58) Field of Classification Search ..... 473/504; 5/420; 248/633, 636; 182/137; 482/17; 47/32

See application file for complete search history.

(56) References Cited

U.S. PATENT DOCUMENTS

| | | | | | |
|---|---|---|---|---|---|
| 76,320 | A * | 4/1868 | Gage | 56/329 |
| 151,136 | A * | 5/1874 | Kelsey et al. | 56/329 |
| 1,092,928 | A * | 4/1914 | Mastin | 248/636 |
| 1,130,546 | A * | 3/1915 | Scott | 47/32 |
| 1,286,947 | A * | 12/1918 | Creed | 56/329 |
| 1,505,558 | A * | 8/1924 | Grabowski | 5/402 |
| 1,931,602 | A * | 10/1933 | Colman | 47/32 |
| 2,596,836 | A * | 5/1952 | Bruhl | 160/370.12 |
| 3,079,728 | A * | 3/1963 | Melin | 446/236 |
| 3,206,892 | A * | 9/1965 | Telkes et al. | 47/19.1 |
| 3,305,969 | A * | 2/1967 | Mattson | 47/32 |
| 3,704,004 | A * | 11/1972 | Carter, Jr. | 256/1 |
| 5,058,317 | A * | 10/1991 | McMurtrey | 47/31.1 |
| 5,085,001 | A * | 2/1992 | Crawley | 47/9 |
| 5,323,557 | A * | 6/1994 | Sonntag | 47/32 |
| 5,379,558 | A * | 1/1995 | Mason, III | 52/105 |
| 5,396,731 | A * | 3/1995 | Byrne | 47/32 |
| 5,490,806 | A * | 2/1996 | Spector | 446/48 |
| 5,678,353 | A * | 10/1997 | Tsao et al. | 47/32 |
| 6,206,753 | B1 * | 3/2001 | Werner | 450/41 |
| 6,519,793 | B1 * | 2/2003 | Le Gette et al. | 5/417 |
| 6,640,490 | B1 * | 11/2003 | Boehringer | 47/9 |

OTHER PUBLICATIONS

On-Deck Circle offered on Internet by OnlineSports.com.

* cited by examiner

*Primary Examiner*—Eugene Kim
*Assistant Examiner*—M. Chambers
(74) *Attorney, Agent, or Firm*—Wall Marjama & Bilinski LLP

(57) ABSTRACT

A mat that may be placed on a baseball or softball playing field for designating a batter on-deck area.

17 Claims, 8 Drawing Sheets

MAT—ADAPTED FOR USE AS A BASEBALL OR SOFTBALL ON-DECK CIRCLE

BACKGROUND OF THE INVENTION

In baseball and softball games, it is conventional to have an on-deck area where a batter may warm up prior to batting in a batter's box adjacent to home plate. The warm up usually includes exercises to stretch a player's muscles, to practice swinging a baseball bat, and to gain a closer inspection of an opposing pitcher's technique as well as the flight of a ball pitched to the opposing team's catcher.

An on-deck area is usually located about half-way between home plate and the home team's dugout, along and away from the first base line, and another on-deck area is usually located about half-way between home plate and the visiting team's bench or dugout, along and away from the third base line.

In many baseball and softball fields, an on-deck area is designated by a chalk line circle, and sometimes with dirt, instead of grass, within the circle. However, many fields are less fastidiously maintained, and have no designated on-deck area.

A player positioned in an on-deck area is subject to various dangers associated with play on the field, such as foul balls being hit towards the player, broken bats or inadvertently thrown bats flying through the air, the opposing team's players chasing foul balls, and the opposing team's players running for back-up position for balls thrown to a base.

It is important for an on-deck area to be properly located so as to minimize these dangers and to have some designation for the area so that an on-deck player does not meander from the area. It is also important for other players to have an appreciation of where the on-deck area is located so that they may avoid collisions with an on-deck player or a bat swung by the on-deck player.

The present invention was developed with an appreciation for better defining on-deck areas than simply using a chalk line or a patch of dirt, and especially for defining on-deck areas in those fields that have no chalk line, dirt patch, or other designation for the on-deck area. The present invention also appreciates that many young boys and girls play baseball and softball and helps to ensure that, when such youngsters are on-deck, they know where the on-deck area is located and do not stray from that area. Also, the present invention provides a strong visual indication to the on-deck player's teammates not to wander or venture into the on-deck area and alerts the opposing team's players of the location of the area so that collisions may be avoided.

SUMMARY OF THE INVENTION

The present invention relates to a mat that may be placed on a baseball or softball playing field for designating a batter on-deck area.

BRIEF DESCRIPTION OF THE DRAWING

The invention will be described with reference to the accompanying drawings, wherein.

DESCRIPTION OF THE PREFERRED EMBODIMENT

The following description of a preferred embodiment is for the purpose of explanation, and not limitation. Some specific details are set forth in order to provide a better understanding of a preferred embodiment of the present invention, however, in other instances, description of other elements, features, and techniques are omitted so as not to encumber or confuse the reader with unnecessary detail. It will be apparent to one skilled in the art that the present invention may be practiced in other embodiments that depart from the following description and that differences may exist from the embodiment specifically described without departing from the spirit and scope of the present invention. The following detailed description is therefore not to be taken in a limiting sense.

Figure 1:
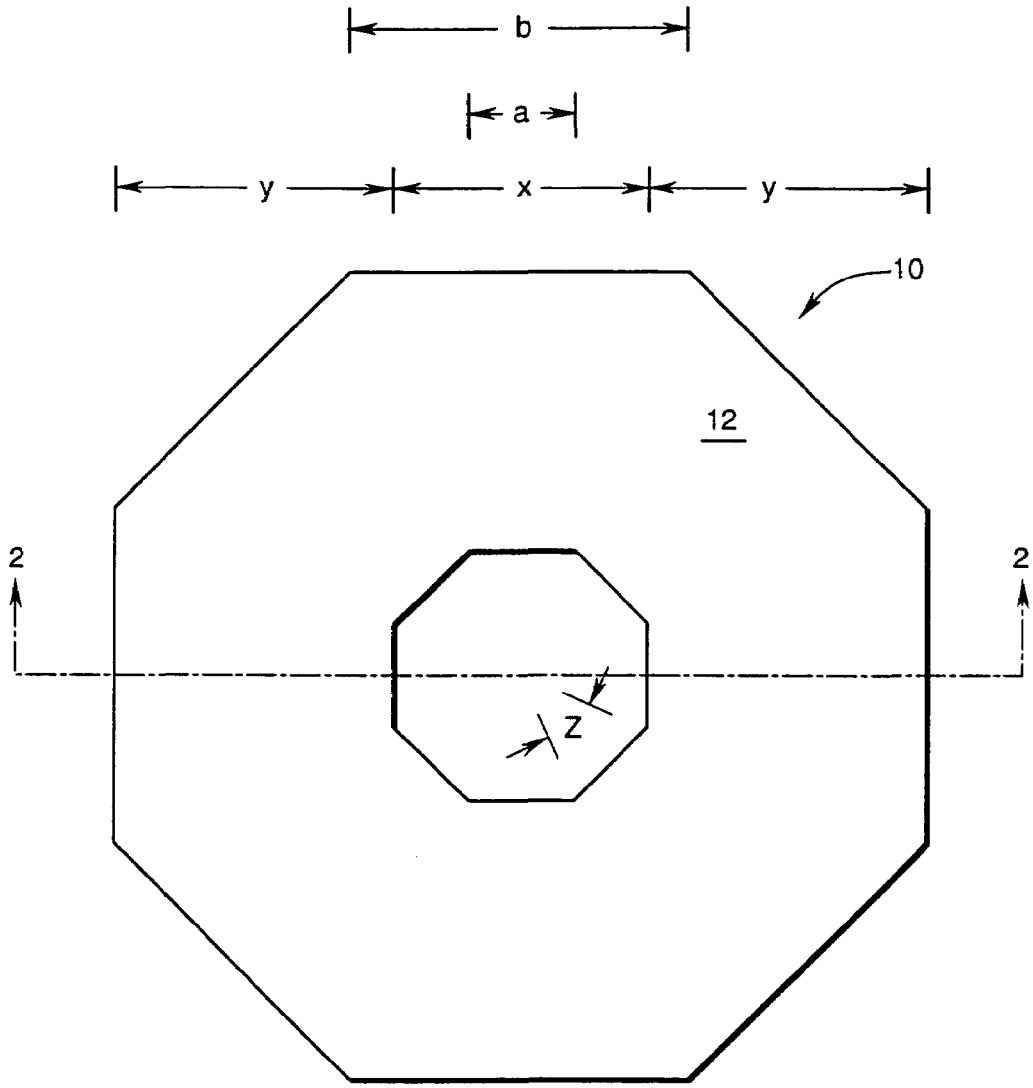
FIG. 1 is a top view of a mat in accordance with one embodiment of the present invention.
Figure 2:
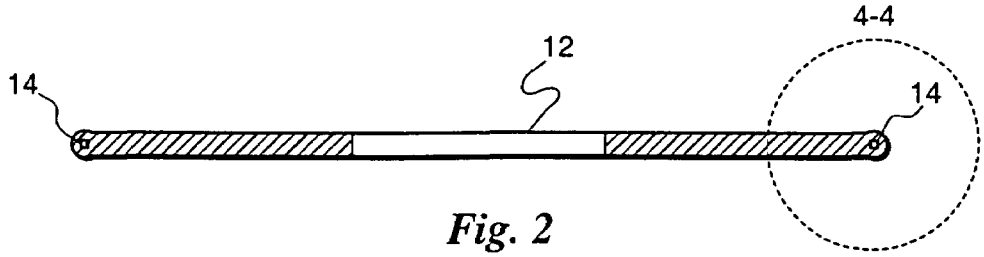
FIG. 2 is a cross sectional view of the mat shown in FIG. 1 taken along the lines 2—2.

The preferred embodiment of the present invention will be described with reference to the accompanying drawings, wherein like reference numerals refer to the same item. There is shown in FIG. 1 a mat 10 formed of a sheet-like material 12, which is preferably flexible. The material 12 may be vinyl coated polyester, preferably eighteen ounce weight, but also may be fashioned of another type of plastic, a geotextile fabric, rubber, canvas, a woven textile, or other suitable material. Preferably the material is washable, does not stain, and is lightweight. The material 12 should also be resistant to puncture or tearing, such as may be caused by the cleats on the bottoms of a player's shoes. Also preferably, the material possesses at least one surface that includes a slip inhibiting texture. When a plastic or rubber material is used, the molding or fabrication process may provide a series of ridges, or may include sand or other particles sprinkled on and embedded in, the material surface.

Figure 15:
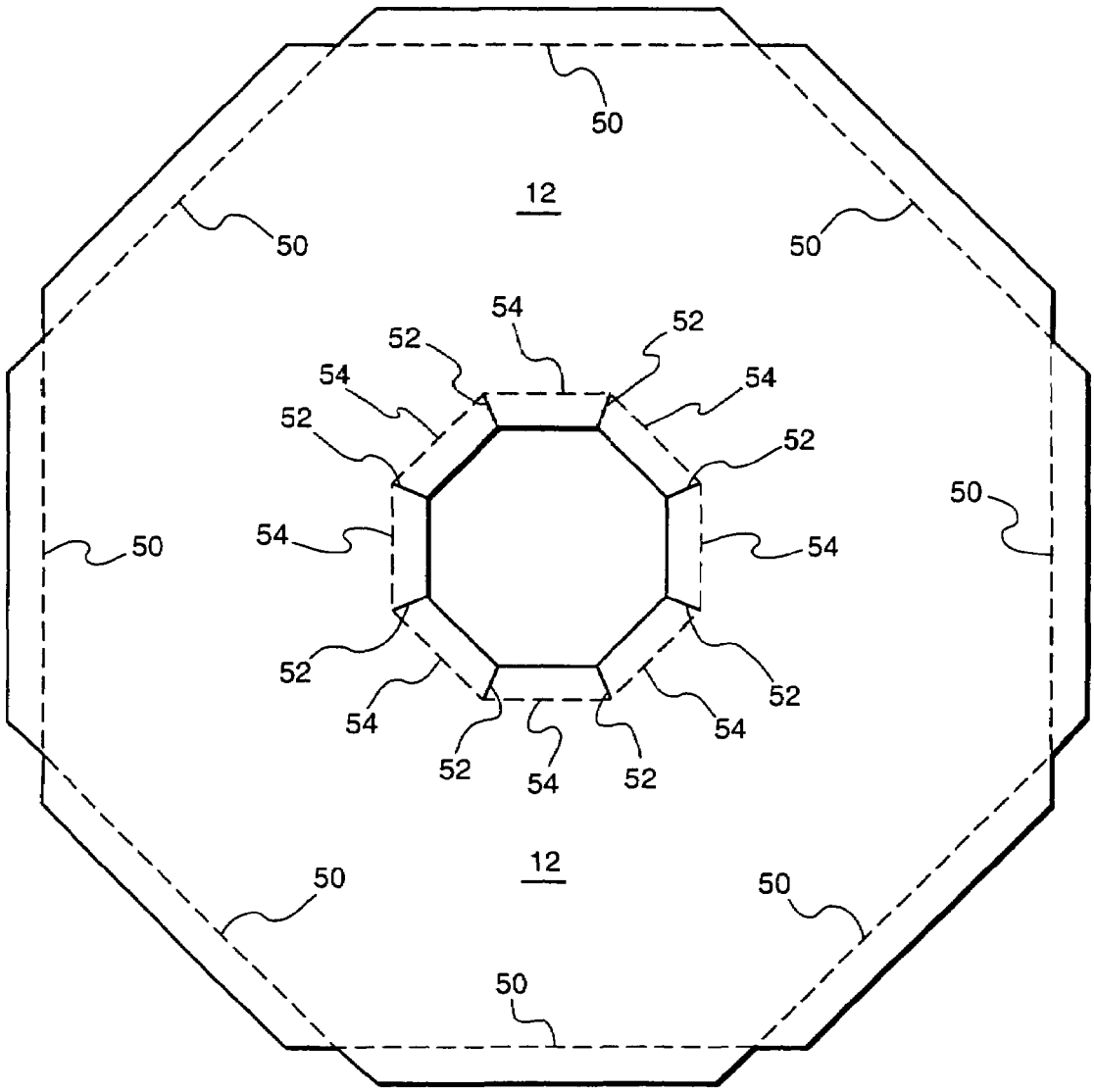
FIG. 15 is a plan view of a material employed in creating a mat in yet another embodiment of the present invention.

It is also preferable that the material 12 be brightly colored, for example, with a single color, a variety of colors, or a series of alternating colors, which colors may correspond with the colors usually associated with the home team or the visiting team. The material 12 may also be imprinted with indicia warning others to stay away from the mat 10, such as being imprinted with the words "STAY BACK" (as shown in FIG. 15) or "DANGER". The material 12 may also be imprinted with indicia about a stadium or team sponsor, such as the name and logo of a restaurant or a car dealership or with indicia about the brand name or logo of the supplier of the mat 10, such as "On-Deck Angel" with an associated logo design.

The mat 10 includes an outer peripheral edge that is fashioned preferably in the shape of a regular polygon, such as a hexagon, an octagon, or a decagon. Likewise, the mat 10 preferably possesses an aperture centrally disposed therein as defined by an inner peripheral edge preferably having a configuration identical to the outer peripheral edge. It is within the contemplation of the present invention that the mat 10 includes no aperture, however, an aperture is preferred so that an on-deck player may stand within the aperture and upon the playing field, and thus gain a better feel for a batting stance and swing, and so that the on-deck player does not cause the mat 10 to scrunch up from the twisting of the player's feet and body during warm up exercises and while practice swinging, and further, so the player does not tend to stray away from the on-deck area. The aperture also helps young players from utilizing improper batting technique, such as "stepping into the bucket".

The preferred dimensions of the mat 10 shown in FIG. 1, which possesses an octagonal outer peripheral edge and an octagonal inner peripheral edge, are as follows. Each of the eight linear segments of the inner peripheral edge possesses a length "a" equal to twelve and three-eighths inches. Each of the eight linear segments of the outer peripheral edge possesses a length "b" of thirty-nine and three-quarters inches. The distance "x" between opposing segments along the inner peripheral edge is thirty inches, and the distance "x" plus 2"y" between opposing segments of the outer peripheral edge equals eight feet. Each segment of the mat 10 extends from a central point at an angle "z" equal to forty-five degrees. The dimensions can be altered depending on the size and needs of batters. Five year olds may require a mat smaller than one for twelve year olds.

In a preferred embodiment of the present invention, the mat 10 includes a plurality of bars 14 that correspond in number to the segments of the outer peripheral edge, and in the preferred embodiment eight. Each bar 14 possesses a length approximately equal to the length of each segment of the outer peripheral edge, but also preferably slightly less than such length. In the preferred embodiment, the length of each bar 14 is in the range of one inch to four inches less than the length of each linear segment of the outer peripheral edge. Such slightly shorter length will help permit the mat 10 to be folded in a manner to be described later herein.

Figure 4:
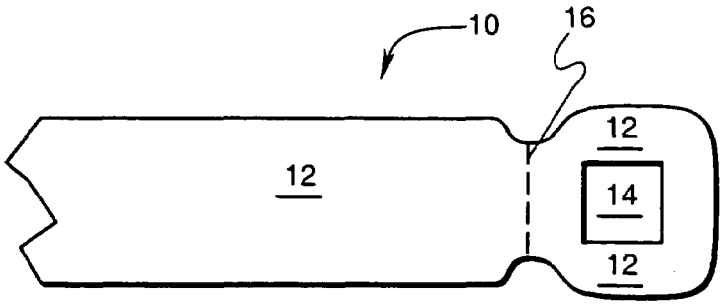
FIG. 4 is a fragmented view of the mat shown in FIG. 2 in the region designated 4—4.

Each bar 14 is preferably disposed in the mat 10 along and adjacent to the corresponding one of the segments of the outer peripheral edge and may be secured to the material 12 by stitching 16, as best shown in FIG. 4. Alternatively, each bar 14 may be captured by heat welding a (plastic) sheet of material 12 about the bar 14, may be secured by an adhesive, may be molded within the material 12, or may be secured by any other suitable means. Each bar 14 may possess a square or rectangular cross section, as shown in FIG. 4, may be circular in cross section (preferably three-eighths inch in outer diameter), or may possess virtually any type of cross section. Also, each bar 14 may possess a hollow interior. Each bar 14 is preferably fashioned from metal, most preferably aluminum, but also may be fashioned from a wide variety of other materials such as wood and plastic. Also preferably, each bar is substantially rigid.

It should be appreciated that the bars 14 help maintain the mat 10 in an uncrumpled, fully extended condition and help prevent the mat 10 from rolling or moving due to wind or contact with a player's shoes. The weight of the bars 14 also helps insure that the outer peripheral edge of the mat 10 remains flat and does not curl up. Also the weight of the bars 14 causes the outer peripheral edge to nestle down in grass. Thus, the bars 14 minimize the possibility of a player tripping over the edge of the mat 10 and inhibit wind from acting upon the mat 10. As such, the bars 14 preferably should be heavy and rigid enough to maintain the mat 10 in a fully extended, flat condition, such as shown in FIG. 1, while at the same time being light enough so as to facilitate transport of the mat 10.

As best shown in FIG. 4, each bar 14 preferably should also have a profile that creates little or no lip or rim, especially no upwardly extending lip.

Figure 3:
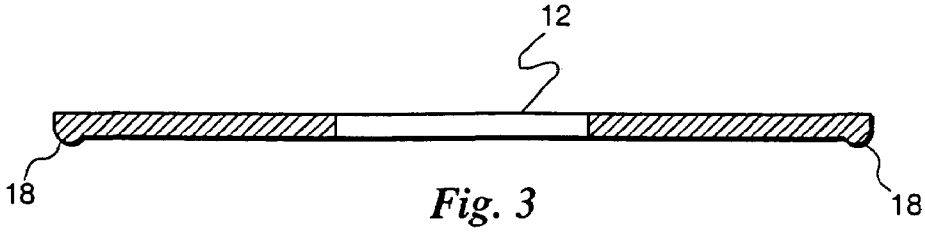
FIG. 3 is a cross sectional view of the mat shown in FIG. 1 taken along the lines 2—2 in accordance with yet another embodiment of the present invention.

In an alternative embodiment, the bar 14 may be integrally formed with the material 12 so as to provide a thickened region along each segment of the outer peripheral edge of the mat 10, as shown in FIG. 3. Such a thickened portion results in a lip or rim 18 that is best disposed in a downward direction, toward the playing field, when the mat 10 is used.

In the preferred embodiment of the present invention, the outer peripheral edge of the mat 10 possesses a length substantially in the range of twenty feet to thirty feet, the inner peripheral edge of the mat 10 possesses a length substantially in the range of six feet to twelve feet, and the mat 10 possesses an area substantially in the range of twenty-five square feet to fifty-five square feet. Also preferably, the mat 10 preferably weighs substantially in the range of eight to thirty pounds.

Figure 5:
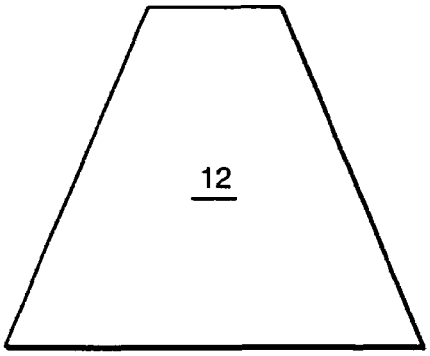
FIG. 5 is a plan view of a segment that may be used in connection with forming the mat shown in FIG. 1.

A method of making the mat 10 in accordance with the present invention will now be described. It should be appreciated that the mat 10 as shown in FIG. 1 may be subdivided into eight identical isosceles trapezoids, such as shown in FIG. 5. Each segment of material 12 possesses a pair of opposing, parallel sides of different lengths and a pair of opposing, non-parallel sides of the same length. By joining eight segments of material 12 as shown in FIG. 5 together along their non-parallel sides, the ring-like shape of the mat 10 as shown in FIG. 1 may be achieved. The segments of material 12 shown in FIG. 5 may be joined by stitching their non-parallel sides together, by adhesive, by heat welding, melting or fusion, by snap-fit connection members, by Velcro hook fasteners, and by any other suitable means.

Figure 6:
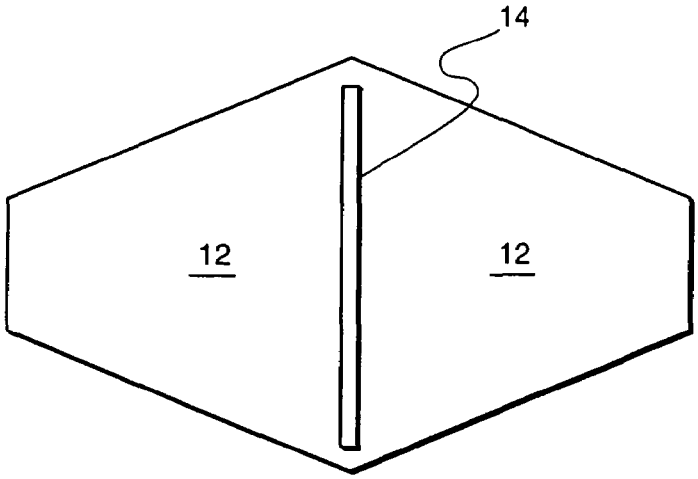
FIG. 6 is a plan view of a sheet of material and a bar that may be used in making the segment shown in FIG. 5.

In order to create a segment formed as an isosceles trapezoid such as shown in FIG. 5, which includes an associated bar 14, the material 12 may be initially formed in a sheet as shown in FIG. 6 with a bar 14 disposed centrally across the sheet, again as shown in FIG. 6. The sheet may then be folded in half so that the bar 14 is captured within, along, and adjacent to an edge of the folded sheet of material 12. The bar 14 may then be secured to the material 12 in such a position by stitching, by an adhesive, by heat welding, and the like, as previously mentioned.

Figure 7:
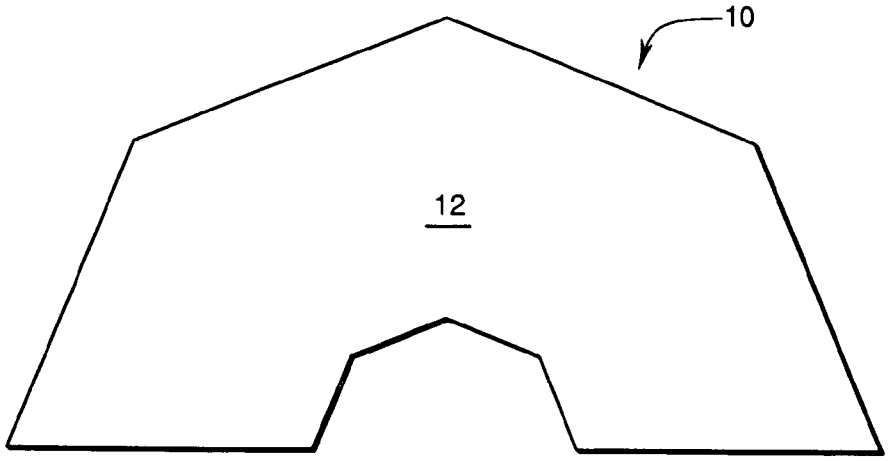
FIG. 7 is a schematic illustration of the mat shown in FIG. 1 folded in half.
Figure 8:
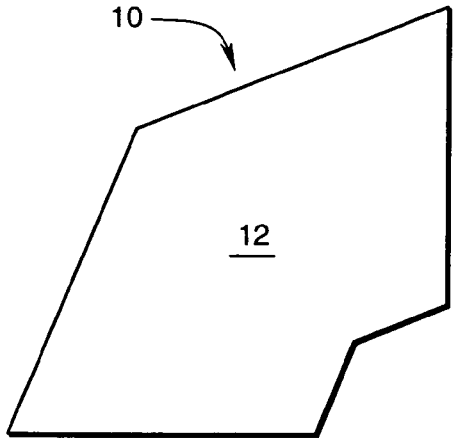
FIG. 8 is a schematic illustration of the mat shown in FIG. 7 folded in half again.
Figure 9:
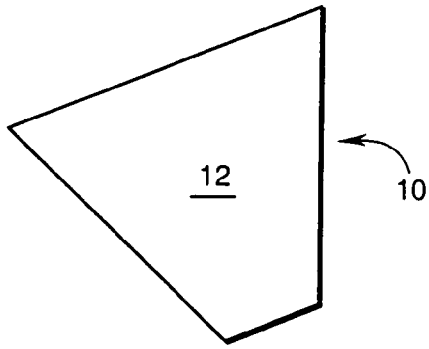
FIG. 9 is a schematic illustration of the mat shown in FIG. 8 folded in half yet again.
Figure 10:
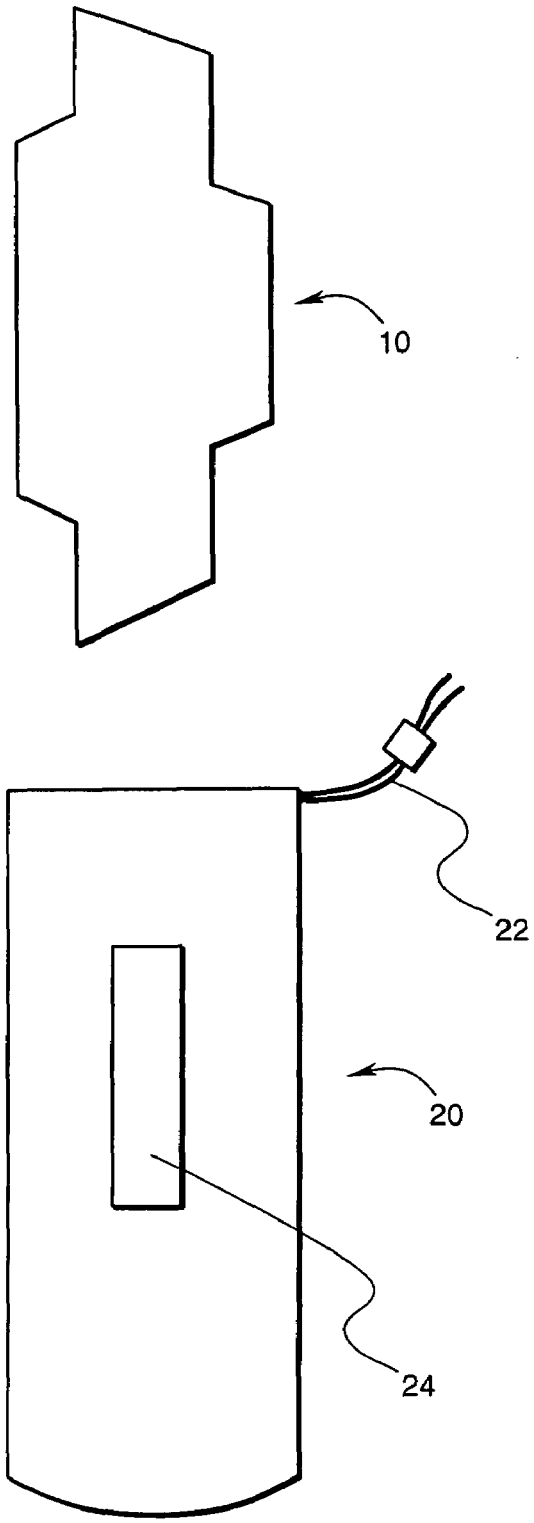
FIG. 10 is a schematic illustration of the mat shown in FIG. 9 in a rolled condition and a bag into which the rolled mat may be stored or transported.

The mat 10 of a preferred embodiment is foldable and rollable for convenient storage and transport. As shown in FIGS. 1 and 7, the mat 10 may be folded in half, and as shown in FIG. 8, may be folded in half again, and as shown in FIG. 9, may be folded in half yet again. When the mat 10 achieves a condition as shown in FIG. 9, it will be appreciated that the bars 14 are disposed in a substantially overlapping condition along the longer of the two opposing parallel sides of the isosceles trapezoid. It will further be appreciated that by making the length of each bar 14 slightly less than the length of an associated segment of the outer peripheral edge of the mat 10, such a folding process may be facilitated. The mat 10 in the folded condition as shown and illustrated in FIG. 9 may be rolled in the configuration condition as shown in FIG. 10. The folded, rolled mat 10 may then be inserted into a corresponding bag 20 for storage and transport. The bag 20 is preferably formed of a flexible material, and an open end thereof may be selectively opened and closed by means of a drawstring 22. One or more handles 24 may be attached to the outer surface of the bag 20 to assist in transporting the bag 20. The invention contemplates that other types of bags and selective closure mechanisms may be utilized.

Figure 16:
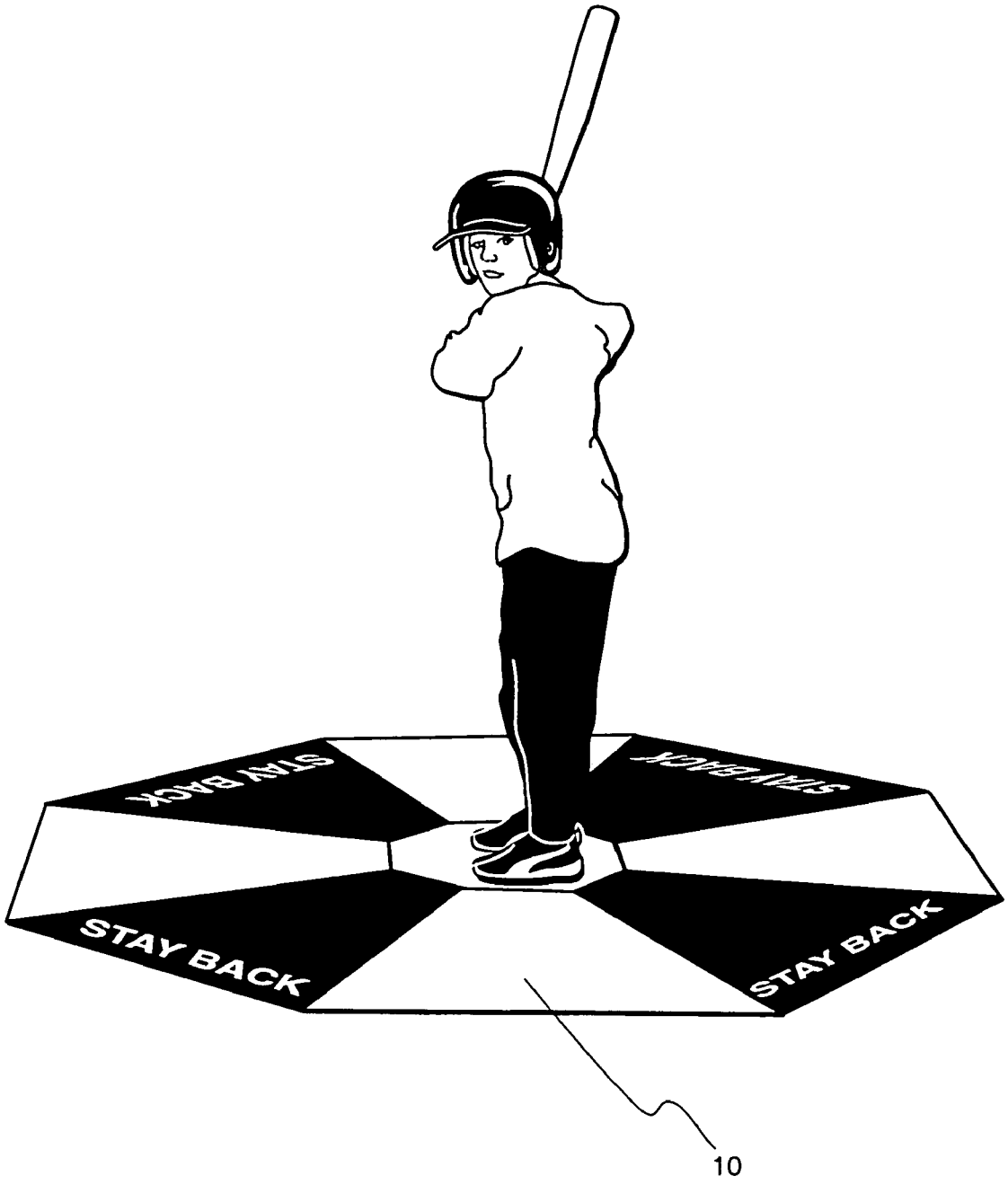
FIG. 16 is a schematic, perspective illustration showing an on-deck player utilizing the mat shown in FIG. 1.

FIG. 16 illustrates a youngster warming up in an on-deck area utilizing the mat 10 in accordance with a preferred embodiment of the present invention.

Figure 11:
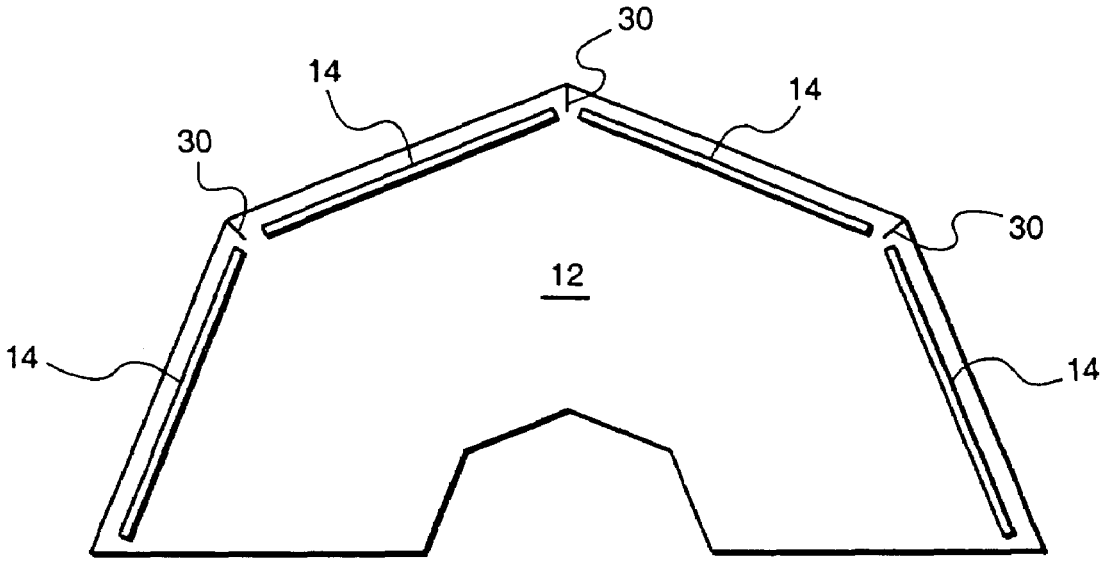
FIG. 11 is a plan view of a sheet of material and a series of bars that may be used in making the mat shown in FIG. 1.
Figure 12:
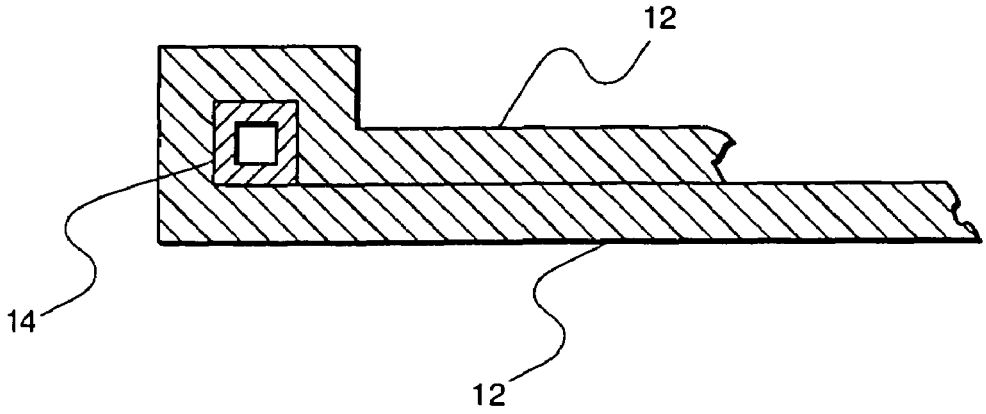
FIG. 12 is a partial, schematic, cross-sectional view of the sheet of material and the series of bars shown in FIG. 11 after further processing in making the mat shown in FIG. 1.

Another method of making a mat 10 in accordance with a preferred embodiment of the present invention is depicted in FIGS. 11 and 12. A sheet of material 12 may be cut or otherwise formed in the shape shown in FIG. 11, which will be readily appreciated as one-half of the ring-like shape of the mat 10 shown in FIG. 1. A bar 14 is placed along, adjacent to, and spaced slightly away from an associated linear segment along the outer peripheral edge of the sheet of material 12. The outer peripheral edge of the material 12 is then folded or rolled over each of the bars 14. To facilitate such folding or rolling over process, the sheet of material 12 may possess a series of short slits 30 extending radially inwardly at each apex between the linear segments of the outer peripheral edge. After the outer peripheral edge is folded or rolled over the bars 14, the edge may be stitched, glued, heat welded, or the like so that the edge secures the bars 14 to the sheet of material 12, such as is shown in FIG. 12. Two of the mat portions so constructed may be joined at the respective edges in any of the manners previously described so as to create the shape of the mat 10 shown in FIG. 1.

Figure 13:
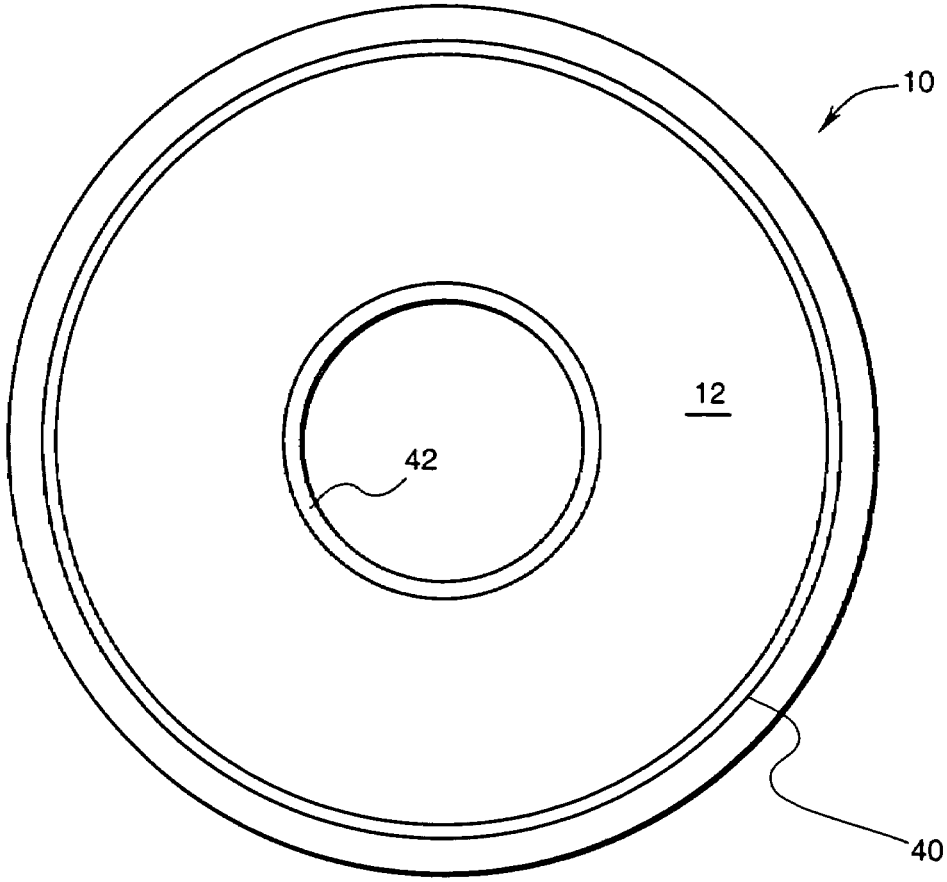
FIG. 13 is a plan view of a sheet of material and a circular bar that may be used in making a mat in accordance with yet another embodiment of the present invention.
Figure 14:
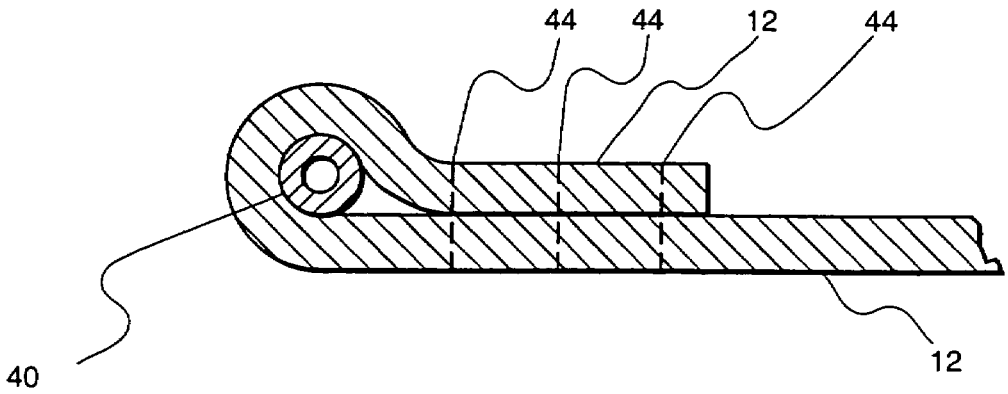
FIG. 14 is a partial, schematic, cross-sectional view of the sheet and the bar shown in FIG. 13 after further processing in connection with making a mat in accordance with the other embodiment of a mat in accordance with the present invention.

There is shown in FIGS. 13 and 14 yet another mat 10 that may be constructed in accordance with another embodiment of the present invention. A sheet of material 12 is fashioned with a circular outer peripheral edge and a circular inner peripheral edge. The inner peripheral edge includes a stiffening sheet or member 42 that may, for example, be an extra layer of material joined to the sheet of material 12 by any of the means previously discussed. Disposed slightly inwardly from the outer peripheral edge of the sheet of material 12 is an endless, helically coiled wire bar 40. The outer peripheral edge of the sheet of material 12 is then rolled or folded over the wire 40 and secures the wire 40 to the sheet of material 12 in any of the manners previously discussed, as shown in FIG. 14 by means of stitch lines 44. It should be appreciated that the sheet material 12 may be provided with a series of radially extending slits about its outer peripheral edge to help facilitate the folding and rolling process.

The coiled wire 40 acts as a torsional spring such that the wire tends to assume a circular shape in a single plane. Nevertheless, the coiled wire 40 is flexible enough so that it can be folded such that the mat 10 may be bundled with twine or straps, or may be selectively contained within an associated bag.

Another method of making a mat 10 in accordance with a preferred embodiment of the present invention is depicted in FIG. 15. A generally planar template fashioned of wood, plastic, metal, or other material is placed over a larger sheet of material and then the material is cut along the inner and outer periphery of the template to create the material 12 in the shape shown in FIG. 15. Each of the eight outer peripheral edge segments may be folded along corresponding fold lines 50 around a corresponding one of the bars 14 and heat welded or the like to capture the corresponding bar 14. The inner peripheral edge of the material 12 may be slit with a series of eight equiangularly spaced, radially extending slits 52 thereby forming a series of eight inner peripheral edge segments, each of which may be folded along corresponding fold lines 54 and secured by heat welding or the like to form a reinforced inner peripheral lip.

It should be appreciated that the present invention contemplates that the shape of the outer peripheral edge of the mat 10 may be other than a regular polygon or circular and that the bars 14 may possess other than a straight or circular configuration. For example, the outer peripheral edge may be circular and the bars 14 may be rigid and curved and may be angularly spaced about the periphery of the mat 10. It is believed that this construction, however, is less preferred because of the increased cost in manufacturing rigid, curved bars and the increased difficulties of compactly rolling such a mat 10 after folding.

The present invention contemplates that ancillary features may be added to the mat 10 of the preferred embodiment, such as providing a reinforcing material along the inner peripheral edge of the mat 10, which is apt to be subject to the most wear. Similarly, the bottom surface of the material 12 may be provided with radially extending stiffening ribs that may be glued, fused, or otherwise suitably secured to the material 12.

While the present invention has been particularly shown and described with reference to the preferred mode as illustrated in the drawing, it will be understood by one skilled in the art that various changes in detail may be effected therein without departing from the spirit and scope of the invention as defined by the claims

I claim:

1. A mat including a material possessing an outer peripheral edge having a plurality of substantially straight segments in the shape of a substantially regular polygon selected from the group consisting of hexagon, octagon, and decagon and including a plurality of substantially straight bars, the number of said bars equal to the number of straight segments in said outer peripheral edge, each of said bars secured to said material and disposed substantially along and substantially adjacent to a corresponding one of said straight segments, the length of each said bar being less than the length of the corresponding one of said straight segments, whereby said mat may be folded diametrically in half and continue to be folded in half until all of said bars substantially overlap.

2. A mat according to claim 1 wherein said material is substantially flexible and wherein when said mat is so folded, then said mat may be rolled.

3. A mat according to claim 1 wherein each of said bars possesses a substantially completely hollow interior.

4. A mat according to claim 1 wherein said outer peripheral edge possesses a length substantially in the range of twenty feet to thirty feet.

5. A mat according to claim 1 wherein said mat weighs substantially in the range of eight to thirty pounds.

6. A mat adapted for use as an on-deck circle for baseball and softball players and adapted for disposition over and substantially against a substantially horizontal surface such as a grass-covered ground, said mat comprising a material that possesses a substantially flat upper surface and a substantially flat lower surface and said material possessing a substantially uniform thickness and possessing a substantially annular configuration with an outer peripheral edge and an inner peripheral edge defining an aperture substantially centrally disposed from said outer peripheral edge, said mat further comprising a series of bars each secured to said material and disposed substantially along and substantially adjacent to the outer peripheral edge of said material, each bar configured in a shape substantially corresponding to the shape of the outer peripheral edge adjacent thereto, whereby when said mat is so disposed, a player may stand within said aperture and directly upon said substantially horizontal surface.

7. A mat according to claim 6 wherein said outer peripheral edge possesses a substantially regular polygon shape.

8. A mat according to claim 7 wherein said outer peripheral edge possesses a substantially octagonal shape.

9. A mat according to claim 8 including a series of eight substantially straight bars secured to said material and disposed substantially about and substantially adjacent to the outer peripheral edge of said material, each bar extending along a corresponding one of said eight sides of said octagonally shaped outer peripheral edge, the length of each said bar being approximately equal to, but slightly less than, the length of the corresponding one of said eight sides of said octagonally shaped outer peripheral edge, whereby said mat may be folded diametrically in half, then folded again in half, and then folded again in half.

10. A mat according to claim 6 wherein said outer peripheral edge possesses a length substantially in the range of twenty feet to thirty feet.

11. A mat according to claim 10 wherein said inner peripheral edge possesses a length substantially in the range of six feet to twelve feet.

12. A mat according to claim 11 wherein said material possesses an area substantially in the range of twenty-five square feet to fifty-five square feet.

13. A mat according to claim 6 wherein said material bears indicia for warning persons to stay away from said mat.

14. A mat according to claim 6 wherein said material is substantially flexible and may be rolled and wherein when said mat is so folded, then said mat further may be rolled.

15. A mat according to claim 14 wherein said mat weighs substantially in the range of eight to thirty pounds.

16. A mat according to claim 6 wherein each of said bars possesses a substantially completely hollow interior.

17. A mat according to claim 6 wherein at least one of said upper surface and said lower surface includes a slip inhibiting texture.

* * * * *